US012077256B2

(12) United States Patent
Liu

(10) Patent No.: US 12,077,256 B2
(45) Date of Patent: Sep. 3, 2024

(54) INFLATABLE KAYAK BOTTOM AND BENDING METHOD THEREOF

(71) Applicant: WEIHAI WINNER INNOVATION OCEAN TECHNOLOGY CO., LTD, Weihai (CN)

(72) Inventor: Peng Liu, Weihai (CN)

(73) Assignee: WEIHAI WINNER INNOVATION OCEAN TECHNOLOGY CO., LTD, Weihai (CN)

( * ) Notice: Subject to any disclaimer, the term of this patent is extended or adjusted under 35 U.S.C. 154(b) by 0 days.

(21) Appl. No.: 17/627,415

(22) PCT Filed: Nov. 12, 2021

(86) PCT No.: PCT/CN2021/130294
§ 371 (c)(1),
(2) Date: Jan. 14, 2022

(87) PCT Pub. No.: WO2023/082172
PCT Pub. Date: May 19, 2023

(65) Prior Publication Data
US 2024/0043101 A1 Feb. 8, 2024

(51) Int. Cl.
*B63B 34/22* (2020.01)

(52) U.S. Cl.
CPC ..... *B63B 34/22* (2020.02)

(58) Field of Classification Search
CPC ..... B63B 34/22
See application file for complete search history.

(56) References Cited

FOREIGN PATENT DOCUMENTS

CN 109820361 A * 5/2019
CN 213139080 U * 5/2021

* cited by examiner

*Primary Examiner* — Stephen P Avila
(74) *Attorney, Agent, or Firm* — ANOVA LAW GROUP, PLLC

(57) ABSTRACT

A bending method for an inflatable kayak bottom includes: step 1: cutting the fabric; step 2: sewing and locking; step 3: performing air seal installation in a hole zone; step 4: performing air seal installation around a drop stitch material and placing a nozzle; and step 5: bending into shape, the inflatable kayak bottom becoming airtight overall. In the present application, the drop stitch material of the kayak bottom is sewn and locked to make a deformable kayak bottom structure, which features low costs, easy use and high practicality.

10 Claims, 5 Drawing Sheets

INFLATABLE KAYAK BOTTOM AND BENDING METHOD THEREOF

CROSS-REFERENCE TO RELATED APPLICATIONS

This application is a national phase entry under 35 U.S.C § 371 of International Application No. PCT/CN2021/130294, filed on Nov. 12, 2021, the entire content of which is incorporated herein by reference.

TECHNICAL FIELD

The present application relates to inflatable water sports equipment and, in particular, to a bending method for an inflatable kayak bottom and the inflatable kayak bottom.

BACKGROUND

With the improvement of living standards, inflatable kayaks have growing popularity among people who like entertainment on water. Inflatable kayaks have the advantages of light weight, small size, and flexibility on water. However, most inflatable kayaks on the market are of the float type made from ordinary airtight fabrics, featuring low strength and weak safety. In addition, while there are inflatable kayaks made from drop stitch material on the market, they generally have a complicated structure with three or more airbags; furthermore, they have no shape and feature low strength after inflation.

In the utility model with the patent application number 202021778837.6 and the patent name Double-Chamber Inflatable Kayak and the patent with the patent application number 201880048963.5 and the patent name Inflatable Kayak and Its Production Process, two different bending methods for inflatable kayaks are disclosed respectively. In both of the methods, however, the bending is performed by joining two inflatable airbags by different means. Two or even more times of inflation are required and the completed structure has many restrictions. The bending may not be doable at any angle, which does not facilitate quick and easy use.

SUMMARY

The purpose of the present application is to apply for a bending method for an inflatable kayak bottom that is quick to use and easy to inflate and for the inflatable kayak bottom.

The embodiment of the present application can be achieved by the following technical solution:

A bending method for an inflatable kayak bottom comprising the following steps:

Step 1: cutting the fabric;

Cutting the fabric 1 into the same shape as the outer contour of the inflatable kayak bottom and getting the required shape, which is the fabric 1;

The fabric 1 includes the inflatable kayak bottom; the inflatable kayak bottom includes the bottom and the sides; between said bottom and sides is the bendable part; the front and the rear of the inflatable kayak bottom include the front opening and the rear opening formed after the cutting;

Step 2: sewing and locking;

Sewing along the preset bendable part on the fabric 1 to get the sewn fabric 2;

Said sewing is performed by passing a thread through the drop stitch material in the bendable part. After sewing, the upper and lower layers of the drop stitch material in the bendable part contact with each other and become inseparable. Several holes will be formed on the drop stitch material when the thread passes through the drop stitch material in the bendable part. Several holes collectively form a hole zone;

Step 3: performing air seal installation in the hole zone;

Covering the outside of the hole zone on both sides of the drop stitch material of the fabric 2 with air seals to prevent leakage of air from inside the hole zone, and the fabric 3 is formed;

Step 4: Performing Air Seal Installation Around the Drop Stitch Material and Placing a Nozzle;

Covering the outside around the fabric 3 with a shaping device. Create an airtight space inside the drop stitch material and place a nozzle on the surface of the fabric 3 to get the fabric 4;

Step 5: bending it into shape and the inflatable kayak bottom becomes airtight overall;

Bending the bendable part of the fabric 4. Sticking together the front opening and the rear opening respectively and covering them with a shaping device;

After bending, covering the inside and outside of the bendable part with a shaping device. Covering the front and the rear with a shaping device from outside. In this way, the bendable part is kept bent and the front and the rear are kept connected. The kayak bottom is formed and completed.

Further, in step 2, said hole zone is located symmetrically in said bendable part on the two sides of said inflatable kayak bottom, with the central axis of said inflatable kayak bottom as the axis of symmetry. Furthermore, all holes of said hole zone on each side take on a continuous arc shape. Each arc formed from holes is a hole line.

Further, there are two said hole lines in the hole zone on each side and the spacing between two said hole lines is between 1.5 cm and 10 cm.

Further, said hole zone includes the front hole zone, the middle hole zone and the rear hole zone, and the spacing between the two hole lines in the front hole zone, the middle hole zone and the rear hole zone differs from one another.

Further, the spacing between the two hole lines in the front hole zone and the rear hole zone is bigger than that between the two hole lines in the middle hole zone.

Further, the spacing between two neighboring holes on a said hole line is between 0.5 cm and 1.5 cm.

An inflatable kayak bottom formed through the aforementioned bending method: Said inflatable kayak bottom is an air chamber. Said inflatable kayak bottom includes the sides, the bottom and the bendable part. Said bendable part comprises the hole zone for sewing. Said hole zone is symmetrical along the central axis of the inflatable kayak bottom. The hole zone on each side contains no less than one hole line. The outside of said hole zone on both the upside and downside of said inflatable kayak bottom is covered with air seals. The outside around said inflatable kayak bottom and the inside and outside of the bendable part after bending are all covered with shaping devices.

Further, there are two hole lines on each side and the spacing between the two hole lines is between 1.5 cm and 10 cm.

Further, said hole zone includes the front hole zone, the middle hole zone and the rear hole zone, and the spacing between the two hole lines in the front hole zone and the rear hole zone is bigger than that between the two hole lines in the middle hole zone.

Further, the spacing between two neighboring holes on a said hole line is between 0.5 cm and 1.5 cm.

The bending method for an inflatable kayak bottom and the inflatable kayak bottom provided in the embodiment of the present application at least have the following beneficial effect: The drop stitch material of the kayak bottom is sewn and locked to make a deformable kayak bottom structure, which features low costs, easy use and high practicality.

REFERENCE SIGNS

Figure 1:
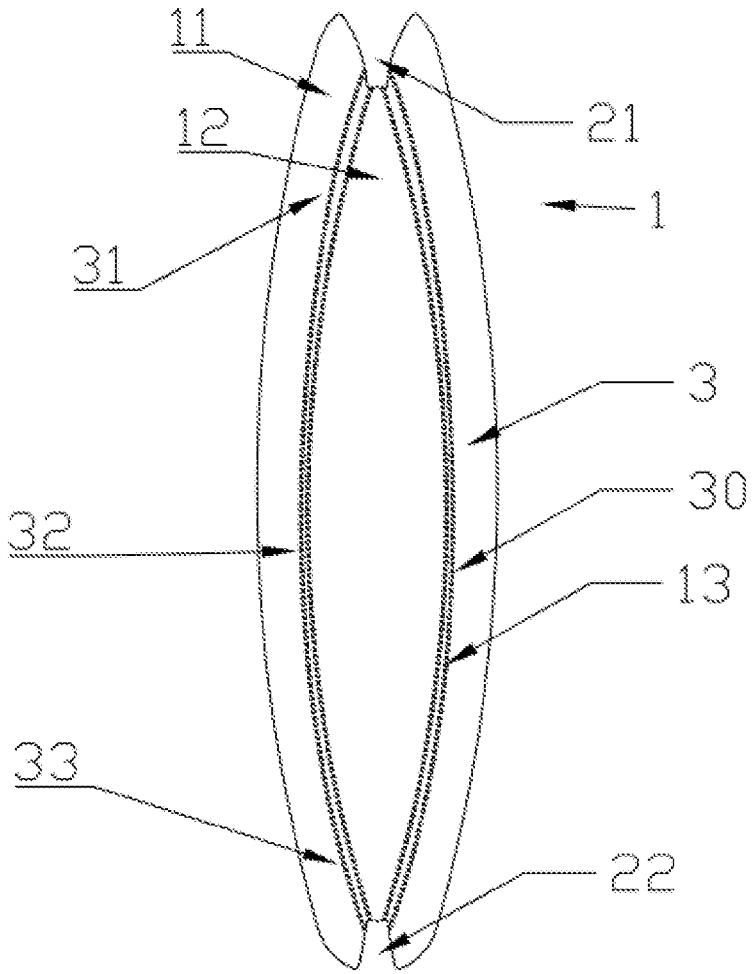
FIG. 1 is a schematic representation of step 1 and step 2 in the bending method for an inflatable kayak bottom.

S kayak bottom; 1 inflatable kayak bottom; 11 sides; 12 bottom; 13 bendable part; 21 front opening; 22 rear opening; 3 hole zone; 30 hole line; 31 front hole zone; 32 middle hole zone; 33 rear hole zone; 4 hole zone air seal; 5 nozzle; 6 shaping device; S kayak bottom.

DETAILED DESCRIPTION

The present application is further explained in the following description based on the preferred embodiment and with reference to the attached drawings.

Furthermore, in order to facilitate understanding, the components in the drawings are enlarged (thickened) or shrunk (thinned), but this is not intended to restrict the scope of protection of the present application.

Any term in the singular applies to the plural and vice-versa.

In the description of the embodiment of the present application, it should be noted that the orientation or positional relationship indicated by the terms "upper", "lower", "inner" "outer" and the like, if any, is the orientation or positional relationship as shown in the drawings, or is the orientation or positional relationship in which the product of the present application is normally placed when in use, and is only intended for convenient and simplified description of the present application, rather than indicating or implying that a device or an element must be positioned in a specific orientation or must be constructed and operated in a specific orientation, and therefore cannot be interpreted as a limitation to the present application. In addition, in the description of the present application, in order to differentiate different units, words such as first and second are used herein, but the use of the sequence words is not restricted by the order of manufacture of the units, nor can it be understood as indicating or implying relative importance. In the detailed description and claims of the application the names of the units may be different.

The terms used herein are intended for explaining the embodiment of the present application, rather than limiting the present application. It should also be noted that, unless otherwise expressly specified in the specification, the terms "provide", "continue", and "connect", if any, should be interpreted in a broad sense; for example, there can be fixed connection, detachable connection or integrated connection; or there can be mechanical connection, direct connection, or indirect connection through a medium; or there can be internal communication of two elements. Those skilled in the art can understand the specific meanings of the above-mentioned terms in the present application.

Figure 2:
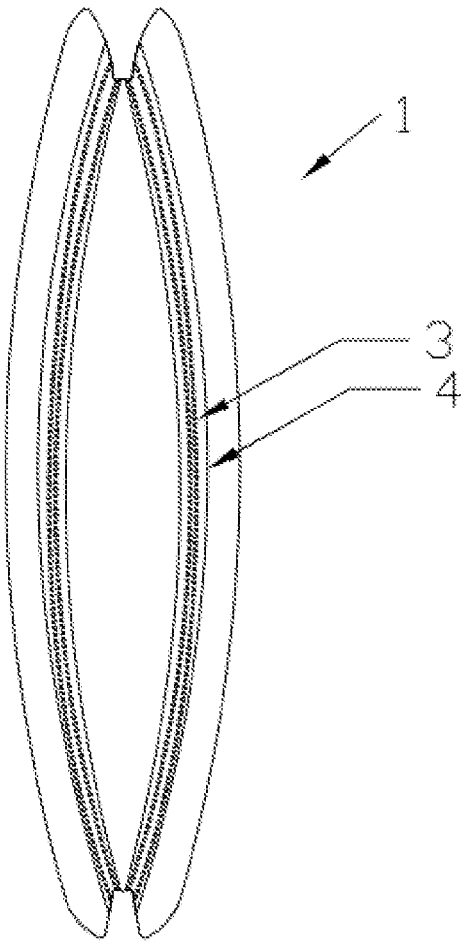
FIG. 2 is a schematic representation of step 3 in the bending method for an inflatable kayak bottom.
Figure 3:
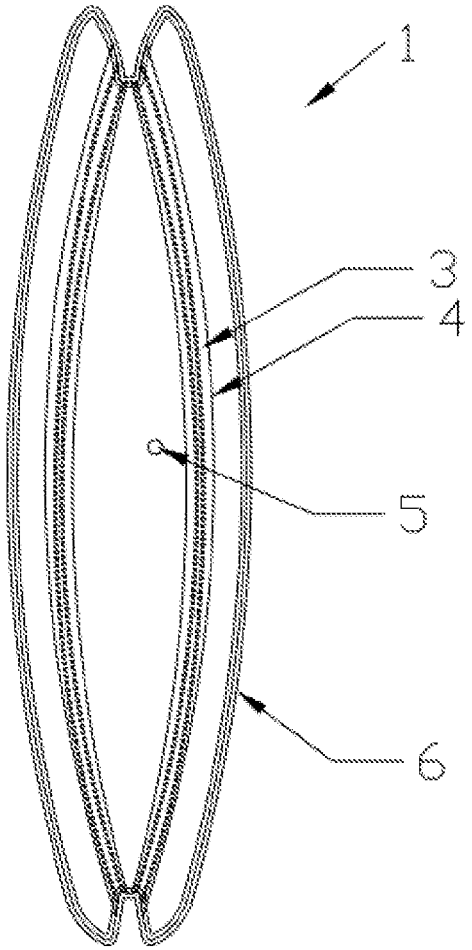
FIG. 3 is a schematic representation of step 4 in the bending method for an inflatable kayak bottom.
Figure 5:
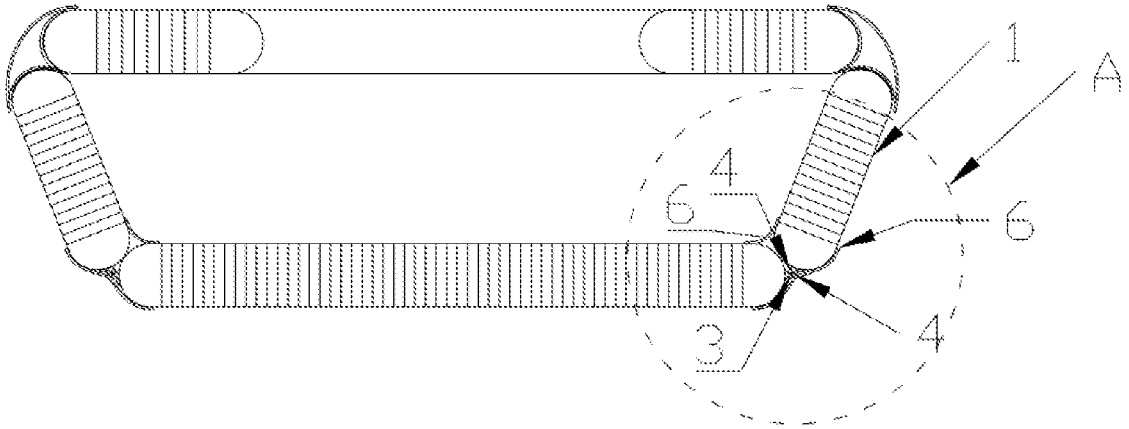
FIG. 5 is a schematic representation of step 5 in the bending method for an inflatable kayak bottom.
Figure 6:
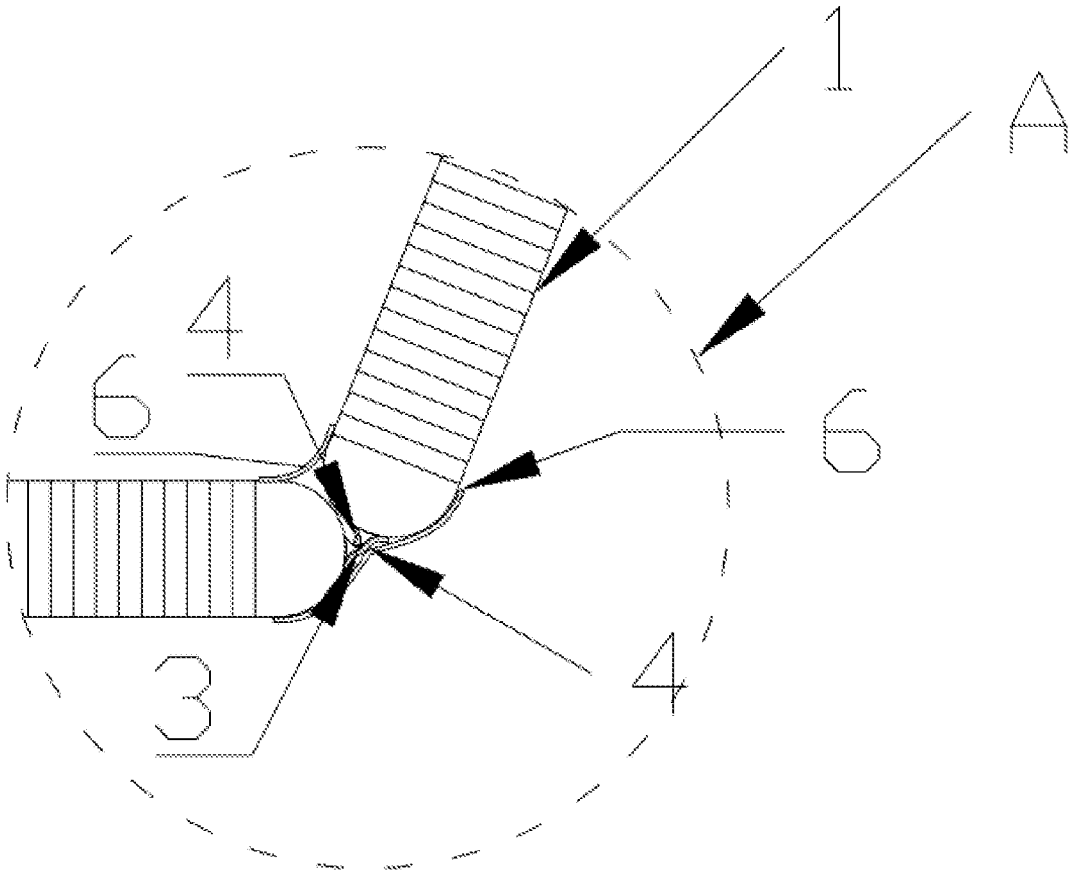
FIG. 6 is a schematic representation of an enlarged view of the location A in FIG. 5.
Figure 7:
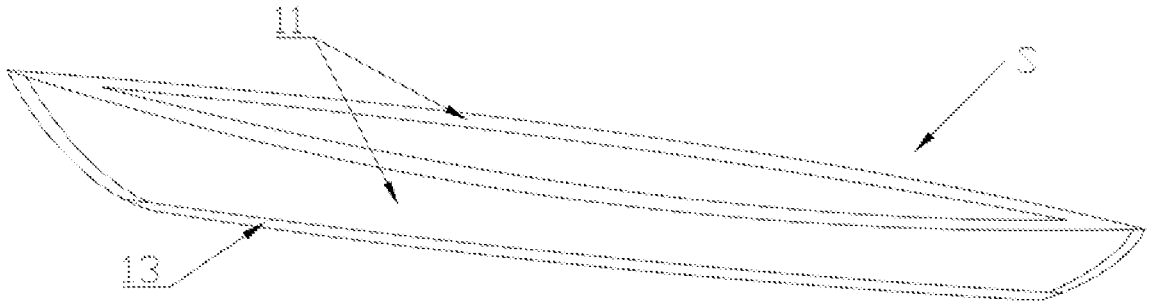
FIG. 7 is a schematic representation of the appearance of an inflatable kayak bottom.

FIG. 1 is a schematic representation of step 1 and step 2 in the bending method for an inflatable kayak bottom; FIG. 2 is a schematic representation of step 3 in the bending method for an inflatable kayak bottom; FIG. 3 is a schematic representation of step 4 in the bending method for an inflatable kayak bottom; FIG. 5 is a schematic representation of step 5 in the bending method for an inflatable kayak bottom; FIG. 6 is a schematic representation of an enlarged view of the location A in FIG. 5.

Please refer to FIGS. 1, 2, 3, 5 and 6 for the bending method for an inflatable kayak bottom, which comprises the following steps:

Step 1: cutting the fabric;

Cutting the fabric 1 into the same shape as the outer contour of the inflatable kayak bottom and get the required shape, which is the fabric 1;

The fabric 1 includes the inflatable kayak bottom 1; the inflatable kayak bottom 1 includes the bottom 12 and the sides 11; between said bottom 12 and sides 11 is the bendable part 13; the front and the rear of the inflatable kayak bottom 1 include the front opening 21 and the rear opening 22 formed after the cutting;

Step 2: sewing and locking;

Sewing along the preset bendable part 13 on the fabric 1 to get the sewn fabric 2;

Said sewing is performed by passing a thread through the drop stitch material in the bendable part 13. After sewing, the upper and lower layers of the drop stitch material in the bendable part 13 contact with each other and become inseparable. Several holes will be formed on the drop stitch material when the thread passes through the drop stitch material in the bendable part 13. Several holes collectively form a hole zone 3;

Step 3: performing air seal installation in the hole zone 3;

Covering the outside of the hole zone 3 on both sides of the drop stitch material of the fabric 2 with air seals 4 to prevent leakage of air from inside the hole zone 3, and the fabric 3 is formed;

Step 4: performing air seal installation around the drop stitch material and placing a nozzle;

Covering the outside around the fabric 3 with a shaping device 6. Creating an airtight space inside the drop stitch material and placing a nozzle on the surface of the fabric 3 to get the fabric 4;

Step 5: Bending it into shape and the inflatable kayak bottom 1 becomes airtight overall;

Bending the bendable part 13 of the fabric 4, sticking together the front opening 21 and the rear opening 22 respectively and covering them with a shaping device 6;

Covering the inside and outside of the bendable part 13 after bending with a shaping device 6, and covering the front and the rear with a shaping device 6 from outside. In this way, the bendable part 13 is kept bent and the front and the rear are kept connected. The kayak bottom S is formed and completed.

In the present embodiment, a thread is used in the sewing in said step 2 and said thread can be nylon, Dacron and the like.

Figure 4:
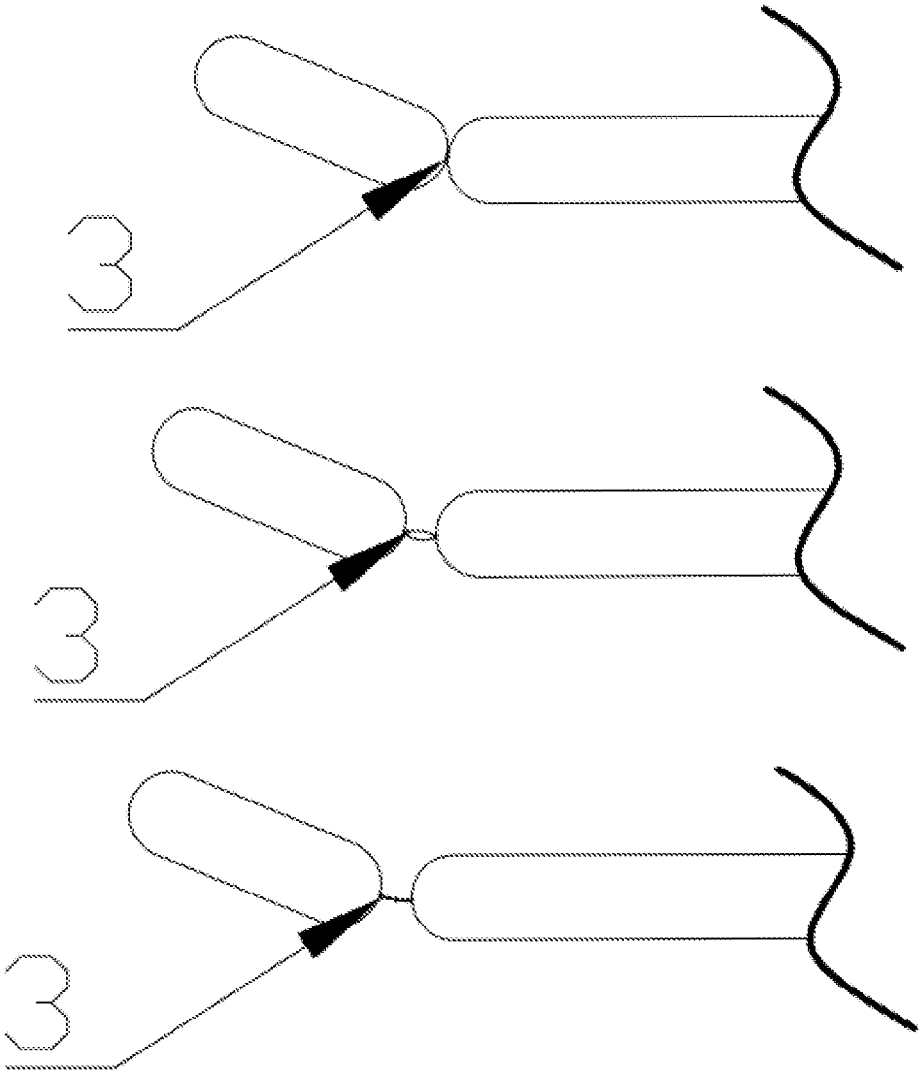
FIG. 4 is a schematic representation of the method of joining different hole zones of an inflatable kayak bottom.

FIG. 4 is a schematic representation of the method of joining different hole zones of an inflatable kayak bottom.

Please refer to FIGS. 1, 2, 3 and 4. In step 2, said hole zone 3 is located symmetrically in said bendable part 13 on the two sides of said inflatable kayak bottom 1, with the central axis of said inflatable kayak bottom 1 as the axis of symmetry. Furthermore, all holes of said hole zone 3 on each side take on a continuous arc shape. Each arc formed from holes is a hole line 30.

Specifically, in the present embodiment, the hole zone is described by referring to the hole zone 3 on one side only.

In the present embodiment, said hole zone 3 contains no less than one hole line 30.

As shown in FIG. 4, there is one, two, and three hole lines 30 from top to bottom.

When there is one said hole line 30, only this hole line 30 forms the bendable area for the bendable part 13 after sewing, where the bendable area of this hole line 30 is limited as the drop stitch material becomes harder after being inflated, leading to a small bending angle and quite difficult bending.

When there are two said hole lines 30, there is certain spacing between the two hole lines 30. This spacing forms the bendable area for the bendable part 13, where the bendable area formed by the two hole lines 30 gives more bendable space to the bendable part as the drop stitch material becomes harder after being inflated. This leads to a greater bending angle and easier bending compared with the case when there is one hole line 30.

When there are three said hole lines 30, there is certain spacing between all the three hole lines 30, where the spacing between the three hole lines forms the bendable area for the bendable part 13. This leads to an even greater bending angle and easier bending compared with the case when there are two hole lines 30.

To have a better view of the effect before different spacing between the hole lines 30, the spacing between the three hole lines 30 is set to the same as the spacing between the two hole lines 30. In other words, the spacing between the hole lines on the two sides of the three hole lines 30 equals to the spacing between the two hole lines. The hole line in the middle of the three hole lines 30 is in the center of the hole lines on the two sides.

In this case, the three hole lines 30 connect the drop stitch material on the two sides to a great extent, leading to declined air circulation within the hole zone 3. In the present embodiment, the final kayak bottom S is an inflatable air chamber structure. Therefore, low air circulation within the hole zone 3 is not conducive to inflation of an air chamber.

Therefore, preferably in the present embodiment, there are two said hole lines 30 on each side of the hole zone 3 and the spacing between the two hole lines 30 is between 1.5 cm and 10 cm.

Further, said hole zone 3 includes the front hole zone 31, the middle hole zone 32 and the rear hole zone 33.

In the present embodiment, the front hole zone 31, the middle hole zone 32 and the rear hole zone 33 are located respectively in the front, middle and rear of said inflatable kayak bottom 1, and the front hole zone 31, the middle hole zone 32 and the rear hole zone 33 take up approximately one third of the area of said inflatable kayak bottom respectively.

In the present embodiment, to make the kayak bottom S take on a better on-water form, the front and the rear of the kayak bottom S are made slightly different, where the spacing between the two hole lines 30 in the front hole zone 31, the middle hole zone 32 and the rear hole zone 33 differs from one another.

Preferably in the present embodiment, the spacing between the two hole lines 30 in the front hole zone 31 and the rear hole zone 33 is bigger than that between the two hole lines 30 in the middle hole zone 32.

Further, to enable faster and easier inflation of said inflatable kayak bottom 1, the spacing between the holes in said hole zone 3 should not be too small.

Preferably in the present embodiment, the spacing between two neighboring holes on a said hole line 30 is between 0.5 cm and 1.5 cm.

In the present embodiment, said hole zone air seals 4 cover the outside of said hole zone 3. To ensure air tightness of said inflatable kayak bottom 1, the outside of both upper and lower sides of the drop stitch material which the sewing passes through is covered with the hole zone air seals 4.

In the present embodiment, said hole zone air seals 4 are made from PVC sandwich mesh cloth.

Heat-sealing, pasting, heat and pressure fusion and the like may be used to make said hole zone air seals 4 cover the outside of said hole zone 3.

Preferably in the present embodiment, the hole zone air seals 4 on the upper and lower sides have the same pasting area.

Preferably, the hole zone air seal 4 is of a tapered structure, that is, the middle of said hole zone air seal is narrow while the two ends are wide. In this way, it fits the spacing between the hole lines 30 of the hole zone 3.

The entirety of said hole zone air seal 4 forms a tapered structure with inclination. When said hole zone air seals 4 are pasted to the outside of the hole zone 3, the air sealing strips pasted at the front hole zone 31 and the rear hole zone 33 are wide while the air sealing strip pasted at the middle hole zone 32 is narrow. This helps the bendable part 13 produce a tapered bending effect.

In the present embodiment, the shaping devices 6 cover the surrounding area of the inflatable kayak bottom 1 and the bendable part 13 after bending.

Heat-sealing, pasting, heat and pressure fusion and the like may be used to make said shaping devices 6 cover the surrounding area of the inflatable kayak bottom 1 and the bendable part 13 after bending. Said shaping devices 6 are made from PVC sandwich mesh cloth.

In the present embodiment, the two sides of the shaping devices 6 that cover the inside and outside of the bendable part 13 are connected with the sides 11 and the bottom 12 respectively.

Preferably, the lengths of the shaping devices 6 that cover the inside and outside of the bendable part 13 after bending are different.

Specifically, after bending, the distance between the two sides on the inner side of the bendable part 13 becomes smaller while that on the outer side of the bendable part 13 becomes bigger. In this case, to achieve better bending and shaping effects while ensuring air tightness of the inflatable kayak bottom 1, the width of the shaping device 6 on the inner side of the bendable part 13 is smaller than that of the shaping device 6 on the outer side of the bendable part 13.

In the present embodiment, the front opening 21 is bigger than the rear opening 22, so that the bow and the stern have different curvatures after the joining of the front opening 21 and the rear opening 22 respectively. This results in greater efficacy of the product and better water-cutting performance.

In the present embodiment, said drop stitch material is drop stitch spacer fabric. The drop stitch spacer fabric has two layers of airtight cloth, with a large number of threads in between that are vertical to the measured surface or cross each other obliquely at an angle. The threads are used to make sure that after the inflatable kayak bottom 1 is inflated, the two layers of airtight cloth will form a plane cavity structure instead of swelling so as to ensure flatness of the inflatable kayak bottom 1.

The present application includes an inflatable kayak bottom manufactured by the aforementioned means. Said inflatable kayak bottom is an air chamber. Said inflatable kayak bottom includes the sides 11, the bottom 12 and the bendable part 13. Said bendable part 13 includes the hole zone 3 for sewing. Said hole zone 3 is symmetrical along the central axis of the inflatable kayak bottom 1. The hole zone 3 on each side contains no fewer than one hole line 30. The outside of said hole zone 3 on both the upside and downside of said inflatable kayak bottom 1 is covered with air seals 4.

The outer side around said inflatable kayak bottom 1 and the inner and outer sides of the bendable part 13 after bending are all covered with the shaping devices 6.

Preferably in the present embodiment, there are two hole lines on each side and the spacing between the two hole lines 30 is between 1.5 cm and 10 cm.

In the present embodiment, said hole lines 30 consist of the front hole zone 31, the middle hole zone 32 and the rear hole zone 33; said front hole zone 31, middle hole zone 32 and rear hole zone 33 are located respectively in the front, middle and rear of said inflatable kayak bottom 1; and the front hole zone 31, the middle hole zone 32 and the rear hole zone 33 take up approximately one third of the space of said inflatable kayak bottom respectively.

In the present embodiment, the spacing between the two hole lines 30 in the front hole zone 31 and the rear hole zone 33 is bigger than that between the two hole lines 30 in the middle hole zone 32.

In the present embodiment, the spacing between two neighboring holes on each hole line 30 is between 0.5 cm and 1.5 cm.

The specific embodiment of the present application has been described in detail above. For those skilled in the art, modifications and improvements can be made to the present application without departing from the principles of the present application. The modifications and improvements are also covered by the protection scope of the claims of the present application.

What is claimed is:

1. A bending method for an inflatable kayak bottom, comprising:

step 1: cutting a fabric, comprising:

cutting a fabric 1 into a same shape as an outer contour of the inflatable kayak bottom and getting the required shape, which is the fabric 1;

wherein the fabric 1 comprises the inflatable kayak bottom; the inflatable kayak bottom comprises a bottom and sides; a bendable part is between the bottom and the sides; front and rear of the inflatable kayak bottom comprise a front opening and a rear opening formed after the cutting;

step 2: sewing and locking, comprising:

sewing along a preset bendable part on the fabric 1 to get a sewn fabric 2;

wherein the sewing is done by passing a thread through a drop stitch material in the bendable part; after sewing, upper and lower layers of the drop stitch material in the bendable part contact with each other and become inseparable; holes are formed on the drop stitch material when the thread passes through the drop stitch material in the bendable part; and the holes collectively form a hole zone;

step 3: performing air seal installation in the hole zone, comprising:

covering outside of the hole zone on both sides of the drop stitch material of the fabric 2 with air seals to prevent leakage of air from inside the hole zone, and fabric 3 is formed;

step 4: performing air seal installation around the drop stitch material and placing a nozzle, comprising:

covering the outside around the fabric 3 with a shaping device; creating an airtight space inside the drop stitch material and placing a nozzle on surface of the fabric 3 to get fabric 4; and step 5: bending into shape and the inflatable kayak bottom becoming airtight overall, comprising:

bending the bendable part of the fabric 4; sticking together the front opening and the rear opening respectively and covering with a shaping device; and after bending, covering the inside and outside of the bendable part with a shaping device; covering the front and the rear with a shaping device from outside; such that the bendable part is kept bent and the front and the rear are kept connected; and the kayak bottom is formed and completed.

2. The bending method for the inflatable kayak bottom according to claim 1, wherein:

in step 2, the hole zone is located symmetrically in the bendable part on two sides of the inflatable kayak bottom, with a central axis of said inflatable kayak bottom as axis of symmetry; furthermore, all holes of the hole zone on each side take on a continuous arc shape; each arc formed from holes is a hole line.

3. The bending method for the inflatable kayak bottom according to claim 2, wherein:

there are two hole lines in the hole zone on each side and a spacing between the two hole lines is between 1.5 cm and 10 cm.

4. The bending method for the inflatable kayak bottom according to claim 3, wherein:

the hole zone includes a front hole zone, a middle hole zone and a rear hole zone, and the spacing between the two hole lines in the front hole zone, the middle hole zone and the rear hole zone differs from one another.

5. The bending method for the inflatable kayak bottom according to claim 4, wherein:

the spacing between the two hole lines in the front hole zone and the rear hole zone is bigger than that between the two hole lines in the middle hole zone.

6. The bending method for the inflatable kayak bottom according to claim 2, wherein:

the spacing between two neighboring holes on the hole line is between 0.5 cm and 1.5 cm.

7. The bending method for the inflatable kayak bottom according to claim 1, wherein:

the inflatable kayak bottom is an air chamber; the inflatable kayak bottom includes sides, a bottom and a bendable part; the bendable part comprises the hole zone for sewing; the hole zone is symmetrical along the central axis of the inflatable kayak bottom; the hole zone on each side contains no less than one hole line; the outside of the hole zone on both upside and downside of the inflatable kayak bottom is covered with air seals; the outside around the inflatable kayak bottom and the inside and outside of the bendable part after bending are all covered with shaping devices.

8. The bending method for the inflatable kayak bottom according to claim 7, wherein:

there are two hole lines on each side and the spacing between the two hole lines is between 1.5 cm and 10 cm.

9. The bending method for the inflatable kayak bottom according to claim 8, wherein:

the hole zone includes front hole zone, middle hole zone and rear hole zone, and the spacing between the two hole lines in the front hole zone and the rear hole zone is bigger than that between the two hole lines in the middle hole zone.

10. The bending method for the inflatable kayak bottom according to claim 9, wherein:

the spacing between two neighboring holes on the hole line is between 0.5 cm and 1.5 cm.

* * * * *